US009506229B2

(12) United States Patent
Esche et al.

(10) Patent No.: US 9,506,229 B2
(45) Date of Patent: Nov. 29, 2016

(54) MAGNETIC DOCKING FAUCET

(71) Applicant: Kohler Co., Kohler, WI (US)

(72) Inventors: John C. Esche, Kohler, WI (US); Perry D. Erickson, Sheboygan, WI (US); Roger W. Murphy, Kohler, WI (US); William R. Bares, Fredonia, WI (US)

(73) Assignee: KOHLER CO., Kohler, WI (US)

( * ) Notice: Subject to any disclaimer, the term of this patent is extended or adjusted under 35 U.S.C. 154(b) by 0 days.

(21) Appl. No.: 14/841,148

(22) Filed: Aug. 31, 2015

(65) Prior Publication Data

US 2015/0368887 A1 Dec. 24, 2015

Related U.S. Application Data

(63) Continuation of application No. 13/787,262, filed on Mar. 6, 2013, now Pat. No. 9,181,685.

(60) Provisional application No. 61/676,711, filed on Jul. 27, 2012.

(51) Int. Cl.

| | |
|---|---|
| ***E03C 1/05*** | (2006.01) |
| ***E03C 1/04*** | (2006.01) |
| *E03C 1/02* | (2006.01) |

(52) U.S. Cl.

CPC ..... *E03C 1/055* (2013.01); *E03C 1/0404* (2013.01); *E03C 2001/026* (2013.01); *E03C 2001/028* (2013.01); *E03C 2001/0415* (2013.01); *Y10T 137/1842* (2015.04); *Y10T 137/598* (2015.04)

(58) Field of Classification Search

CPC ..... E03C 1/055; E03C 1/0404

USPC ..... 137/801; 4/675

See application file for complete search history.

(56) References Cited

U.S. PATENT DOCUMENTS

| | | | |
|---|---|---|---|
| 2,697,642 | A | 12/1954 | Rudy |
| 2,793,057 | A | 5/1957 | McGugin |
| 3,104,088 | A | 9/1963 | Cator |
| 3,181,895 | A | 5/1965 | Cator |
| 3,265,075 | A | 8/1966 | Edman, et al. |
| 3,586,048 | A | 6/1971 | Arnold |
| 3,840,041 | A | 10/1974 | McMurray |

(Continued)

FOREIGN PATENT DOCUMENTS

| | | |
|---|---|---|
| CN | 101812858 | 8/2010 |
| CN | 201715084 | 1/2011 |

(Continued)

OTHER PUBLICATIONS

Grohe Product Catalog pages, Stainless Steel Pull-Out Spray, 2004, 4 pages.

(Continued)

*Primary Examiner* — Kevin Murphy
*Assistant Examiner* — Nicole Wentlandt
(74) *Attorney, Agent, or Firm* — Foley & Lardner LLP

(57) ABSTRACT

A faucet is provided. The faucet has a spout and a sprayhead releasably coupled to the spout. A hose having a magnetically responsive collar thereon provides fluid through the spout to the sprayhead. A magnet is located in the faucet such that when the sprayhead is coupled to the spout, the collar magnetically couples to the magnet, thereby applying sufficient magnetic force to the hose to retain the sprayhead against the spout.

20 Claims, 10 Drawing Sheets

(56) References Cited

U.S. PATENT DOCUMENTS

| | | | |
|---|---|---|---|
| 4,049,295 | A | 9/1977 | Piers |
| 4,205,678 | A | 6/1980 | Adair |
| 4,232,695 | A | 11/1980 | Roberge |
| 4,304,256 | A | 12/1981 | Taiani |
| 4,384,703 | A | 5/1983 | Ruyak et al. |
| 4,427,960 | A | 1/1984 | Wuerfel |
| 4,651,720 | A | 3/1987 | Baus |
| 4,671,486 | A | 6/1987 | Giannini |
| 4,716,922 | A | 1/1988 | Camp |
| 4,718,131 | A | 1/1988 | Kitamura et al. |
| 5,025,510 | A | 6/1991 | Basile |
| 5,096,230 | A | 3/1992 | Pausch et al. |
| 5,277,391 | A | 1/1994 | Haug et al. |
| 5,318,328 | A | 6/1994 | Dawson |
| 5,419,354 | A | 5/1995 | Krynicki |
| 5,645,302 | A | 7/1997 | Horimoto |
| 5,727,769 | A | 3/1998 | Suzuki |
| 5,758,690 | A | 6/1998 | Humpert et al. |
| 5,771,934 | A | 6/1998 | Warshawsky |
| 5,822,811 | A | 10/1998 | Ko |
| 6,023,951 | A | 2/2000 | Maurer et al. |
| 6,034,465 | A | 3/2000 | McKee et al. |
| 6,202,980 | B1 | 3/2001 | Vincent et al. |
| 6,220,297 | B1 | 4/2001 | Marty et al. |
| 6,370,713 | B2 | 4/2002 | Bosio |
| 6,381,770 | B1 | 5/2002 | Raisch |
| 6,387,096 | B1 | 5/2002 | Hyde, Jr. |
| 6,390,717 | B1 | 5/2002 | Bar |
| 6,446,278 | B1 | 9/2002 | Lin |
| 6,594,832 | B2 | 7/2003 | Yang |
| 6,619,567 | B1 | 9/2003 | Ouyoung |
| 6,757,921 | B2 | 7/2004 | Esche |
| 6,786,239 | B1 | 9/2004 | Welsh |
| 6,808,131 | B2 | 10/2004 | Bosio |
| 6,810,539 | B2 | 11/2004 | Bosio |
| 6,845,526 | B2 | 1/2005 | Malek et al. |
| 6,877,172 | B2 | 4/2005 | Malek et al. |
| 6,910,604 | B2 | 6/2005 | Gugliotti et al. |
| 6,915,816 | B2 | 7/2005 | Nelson et al. |
| 6,938,837 | B2 | 9/2005 | Nelson et al. |
| 7,000,854 | B2 | 2/2006 | Malek et al. |
| 7,070,125 | B2 | 7/2006 | Williams et al. |
| 7,104,473 | B2 | 9/2006 | Bosio |
| 7,114,510 | B2 | 10/2006 | Peters et al. |
| 7,150,293 | B2 | 12/2006 | Jonte |
| 7,162,802 | B2 | 1/2007 | Benardeau et al. |
| 7,246,757 | B2 | 7/2007 | Juo |
| 7,252,112 | B1 | 8/2007 | Imler et al. |
| 7,438,768 | B2 | 10/2008 | Sakaki et al. |
| 7,472,433 | B2 | 1/2009 | Rodenbeck et al. |
| 7,487,796 | B2 | 2/2009 | Imler et al. |
| 7,520,105 | B2 | 4/2009 | Geller |
| 7,537,023 | B2 | 5/2009 | Marty et al. |
| 7,563,249 | B2 | 7/2009 | Schriver et al. |
| 7,669,899 | B2 | 3/2010 | Carson |
| 7,699,241 | B2 | 4/2010 | Benstead |
| 7,748,406 | B2 | 7/2010 | Pilatowicz et al. |
| 7,753,079 | B2 | 7/2010 | Nelson |
| 7,793,987 | B1 | 9/2010 | Busch et al. |
| 7,909,061 | B2 | 3/2011 | Nelson |
| 8,104,113 | B2 | 1/2012 | Rodenbeck et al. |
| 8,118,240 | B2 | 2/2012 | Rodenbeck et al. |
| 8,205,846 | B2 | 6/2012 | Glunk |
| 8,387,661 | B2 | 3/2013 | Nelson |
| 8,496,028 | B2 | 7/2013 | Nelson et al. |
| 2001/0011561 | A1 | 8/2001 | Marty et al. |
| 2001/0020302 | A1 | 9/2001 | Bosio |
| 2002/0017239 | A1 | 2/2002 | Di Gioia et al. |
| 2003/0041372 | A1 | 3/2003 | Yang |
| 2004/0135009 | A1 | 7/2004 | Malek et al. |
| 2004/0177880 | A1 | 9/2004 | Nelson et al. |
| 2004/0258567 | A1 | 12/2004 | Kokin et al. |
| 2005/0000702 | A1 | 1/2005 | Shim |
| 2005/0125893 | A1 | 6/2005 | Zhadanov et al. |
| 2005/0132488 | A1 | 6/2005 | Biondo et al. |
| 2005/0189438 | A1 | 9/2005 | Bosio |
| 2006/0130907 | A1 | 6/2006 | Marty et al. |
| 2006/0200903 | A1 | 9/2006 | Rodenbeck et al. |
| 2006/0213585 | A1 | 9/2006 | Nakamura et al. |
| 2006/0283511 | A1 | 12/2006 | Nelson |
| 2007/0001018 | A1 | 1/2007 | Schmitt et al. |
| 2007/0022528 | A1 | 2/2007 | Gilbert |
| 2007/0040380 | A1 | 2/2007 | Benstead |
| 2007/0170284 | A1 | 7/2007 | Nelson et al. |
| 2007/0246267 | A1 | 10/2007 | Koottungal |
| 2007/0246550 | A1 | 10/2007 | Rodenbeck et al. |
| 2007/0246564 | A1 | 10/2007 | Rodenbeck et al. |
| 2007/0277887 | A1 | 12/2007 | Imler et al. |
| 2008/0143098 | A1 | 6/2008 | Zimmermann et al. |
| 2008/0178957 | A1 | 7/2008 | Thomas et al. |
| 2008/0185060 | A1 | 8/2008 | Nelsson |
| 2008/0196160 | A1 | 8/2008 | Alder et al. |
| 2008/0223454 | A1 | 9/2008 | Pilatowicz et al. |
| 2008/0283083 | A1 | 11/2008 | Piao |
| 2009/0007330 | A1 | 1/2009 | Genord et al. |
| 2009/0039176 | A1 | 2/2009 | Davidson et al. |
| 2009/0120516 | A1 | 5/2009 | Paini |
| 2009/0146412 | A1 | 6/2009 | Schoenoff et al. |
| 2009/0200794 | A1 | 8/2009 | Esche et al. |
| 2009/0205122 | A1 | 8/2009 | Biondo et al. |
| 2009/0302181 | A1 | 12/2009 | Glunk |
| 2010/0043135 | A1 | 2/2010 | Patterson et al. |
| 2010/0170587 | A1 | 7/2010 | Kaess |
| 2010/0170588 | A1 | 7/2010 | Nelson |
| 2010/0212761 | A1 | 8/2010 | Hart |
| 2010/0307497 | A1 | 12/2010 | Busch et al. |
| 2011/0162743 | A1 | 7/2011 | Nelson |
| 2012/0097874 | A1 | 4/2012 | Rodenbeck et al. |

FOREIGN PATENT DOCUMENTS

| | | |
|---|---|---|
| CN | 201776197 | 3/2011 |
| CN | 202527291 | 11/2012 |
| CN | 202546003 | 11/2012 |
| CN | 202691206 | 1/2013 |
| DE | 14 89 255 | 8/1969 |
| DE | 40 00 621 | 7/1991 |
| DE | 93 00 418 | 3/1993 |
| DE | 196 49 006 | 5/1998 |
| DE | 201 17 761 | 2/2002 |
| DE | 202 11 780 | 9/2002 |
| DE | 102 60 207 | 6/2004 |
| EP | 0 910 32 | 10/1983 |
| EP | 1 201 836 | 5/2002 |
| EP | 1 367 183 | 12/2003 |
| EP | 1 350 895 | 2/2006 |
| EP | 2 042 663 | 4/2009 |
| EP | 2378011 | 10/2011 |
| FR | 2197395 | 3/1974 |
| GB | 1 303 959 | 1/1973 |
| GB | 2 285 919 | 8/1995 |
| GB | 2 397 519 | 7/2004 |
| GB | 2 431 861 | 5/2007 |
| JP | 05-148868 | 6/1993 |
| JP | 06-043069 | 6/1994 |
| JP | 2000-263060 | 9/2000 |
| JP | 2002-068270 | 3/2002 |
| JP | 2002-223969 | 8/2002 |
| JP | 2005-090099 | 4/2005 |
| JP | 2007-262838 | 10/2007 |
| JP | 2009-028140 | 2/2009 |
| JP | 06-046929 | 2/2010 |
| NL | 1028853 | 10/2006 |
| WO | WO-92/04509 | 3/1992 |
| WO | WO-2005/026457 | 3/2005 |
| WO | WO-2005/098150 | 10/2005 |
| WO | WO-2007/019718 | 2/2007 |
| WO | WO-2008/107101 | 9/2008 |
| WO | WO-2008/107102 | 9/2008 |

(56) References Cited

FOREIGN PATENT DOCUMENTS

| | | |
|---|---|---|
| WO | WO-2008/107103 | 9/2008 |
| WO | WO-2010/021765 | 2/2010 |

OTHER PUBLICATIONS

Latoscana Elba Kitchen Faucet with Magnetic Spray, Brushed Nickel Finish, Model 78PW557PMEX, retrieved from www.thehomedepot.com prior to May 3, 2007, 2 pages.

Latoscana Elba Kitchen Faucet with Magnetic Spray, Model 78CR557M, Design Specifications, retrieved from www.latoscanacollection.com prior to May 3, 2007, 3 pages.

Latoscana Elba Kitchen Faucet with Magnetic Spray, Model 78CR557PMEX, retrieved from www.thehomedepot.com prior to May 3, 2007, 2 pages.

European Search Report dated May 7, 2015 for Application No. 13178072.8, 6 pages.

MAGNETIC DOCKING FAUCET

CROSS REFERENCE TO RELATED APPLICATIONS

This application is a Continuation of U.S. patent application Ser. No. 13/787,262, filed on Mar. 6, 2013, which claims the benefit of priority to U.S. Provisional Patent Application No. 61/676,711, filed on Jul. 27, 2012, both of which are incorporated by reference herein in their entireties.

BACKGROUND

The present application relates generally to the field of faucets. More specifically, the present application relates to systems and methods for releasably coupling a pullout sprayhead to a faucet body.

Some faucets, kitchen faucets in particular, employ a sprayhead attached to a flexible hose. When not needed, the sprayhead is typically docked into an end of a spout. Conventional methods for retaining the sprayhead in the spout include counterweights, mechanical snaps, compression fittings, and compression springs. U.S. Pat. No. 7,753,079 discloses using a magnet attached to each of the sprayhead and the end of the spout to retain the sprayhead therein. Counterweights may be noisy or come to rest on pipes or other items under the sink. Mechanical snaps and compression fit systems may wear over time. Compression springs may be noisy and tend to have a high retraction force when the sprayhead is fully extended and a low retraction force when the sprayhead is docked. Magnets in the sprayhead and at the end of the spout are often limited in size or drive the shape of the spout outlet, limiting aesthetic design options. Accordingly, there is a need for an improved docking system for releasably coupling a pullout sprayhead to a faucet body.

SUMMARY

One embodiment relates to a faucet having a spout and a sprayhead releasably coupled to the spout. A hose having a magnetically responsive collar thereon provides fluid through the spout to the sprayhead. A magnet is located in the faucet such that when the sprayhead is coupled to the spout, the collar magnetically couples to the magnet, thereby applying sufficient magnetic force to the hose to retain the sprayhead against the spout.

Another embodiment relates to a faucet having a sprayhead releasably supported by a spout, a hose passing through the spout, a magnetically responsive collar coupled to the hose, and a magnet. The hose has a first end for receiving fluid from a fluid source and a second end fluidly coupled to the sprayhead. The magnet is located in the faucet such that when the sprayhead is supported by the spout, the collar magnetically couples to the magnet, thereby applying sufficient magnetic force to the hose to retain the sprayhead against the spout.

Another embodiment relates to an apparatus for a releasably retaining a hose relative to a body. The apparatus includes a magnet defining an opening passing axially therethrough, a retainer having a sidewall extending axially through the opening of the magnet, the sidewall defining a bore, and a hose passing through the bore of the retainer. The hose includes a magnetically responsive collar coupled to the hose, an extracted position, in which the collar and the magnet magnetically decouple, and a refracted position, in which the collar and the magnet magnetically couple and the collar is located at least partially in the opening of the retainer.

The foregoing is a summary and thus by necessity contains simplifications, generalizations and omissions of detail. Consequently, those skilled in the art will appreciate that the summary is illustrative only and is not intended to be in any way limiting. Other aspects, inventive features, and advantages of the devices and/or processes described herein, as defined solely by the claims, will become apparent in the detailed description set forth herein and taken in conjunction with the accompanying drawings.

DETAILED DESCRIPTION

Referring generally to the FIGURES, a faucet having a magnetic docking system and components thereof are shown according to an exemplary embodiment. The faucet includes a body, a spout, and a sprayhead releasably coupled to the spout. A hose carries fluid through the spout to the sprayhead, where the fluid is ejected (e.g., released, sprayed, output) to the environment, for example, into a basin, sink, tub, or shower stall.

Figure 1:
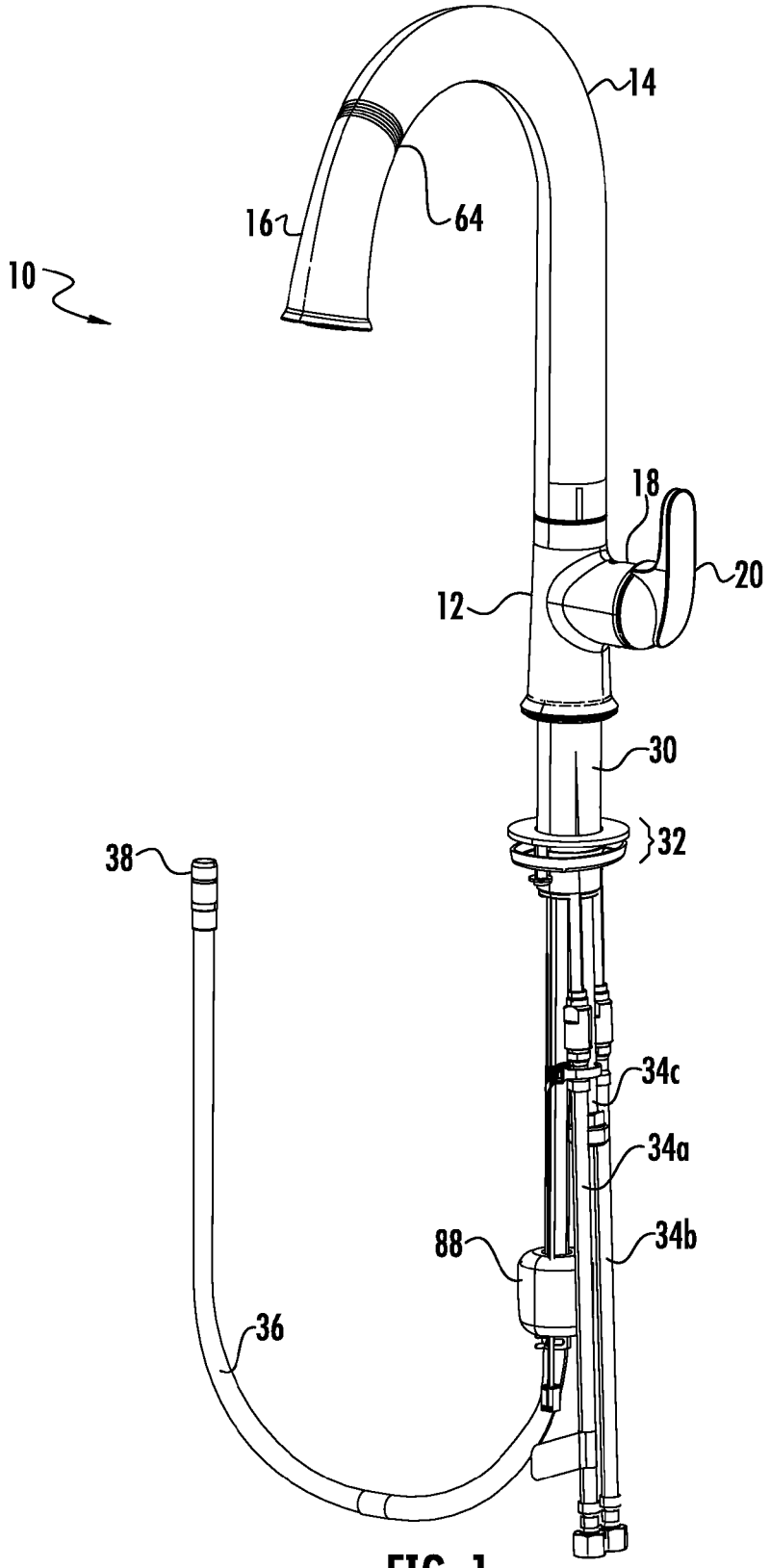
FIG. 1 is a top, front, right perspective view of a faucet, shown according to an exemplary embodiment.
Figure 2:
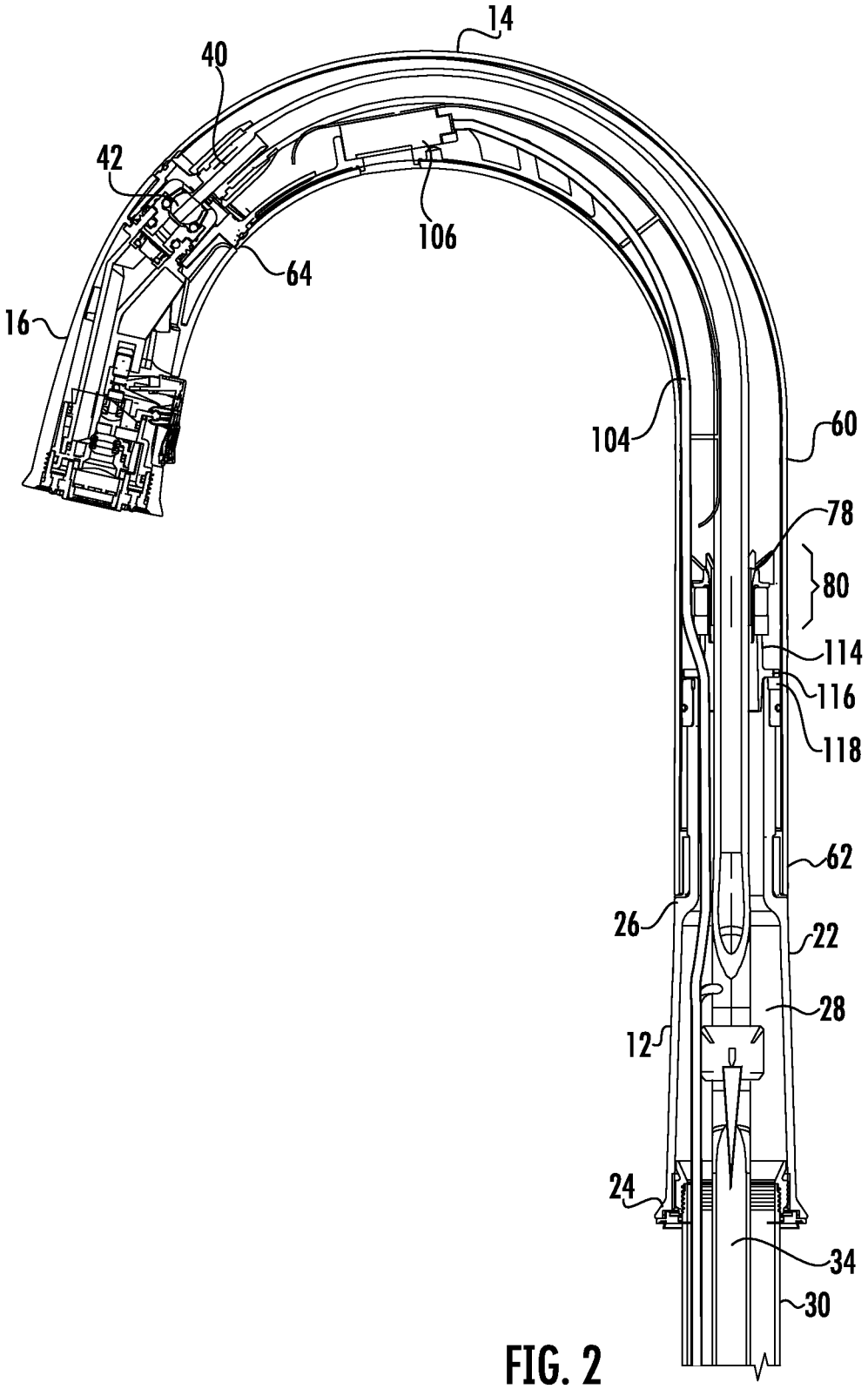
FIG. 2 is a right side elevational cross-section view of the faucet of FIG. 1, shown according to an exemplary embodiment.
Figure 7:
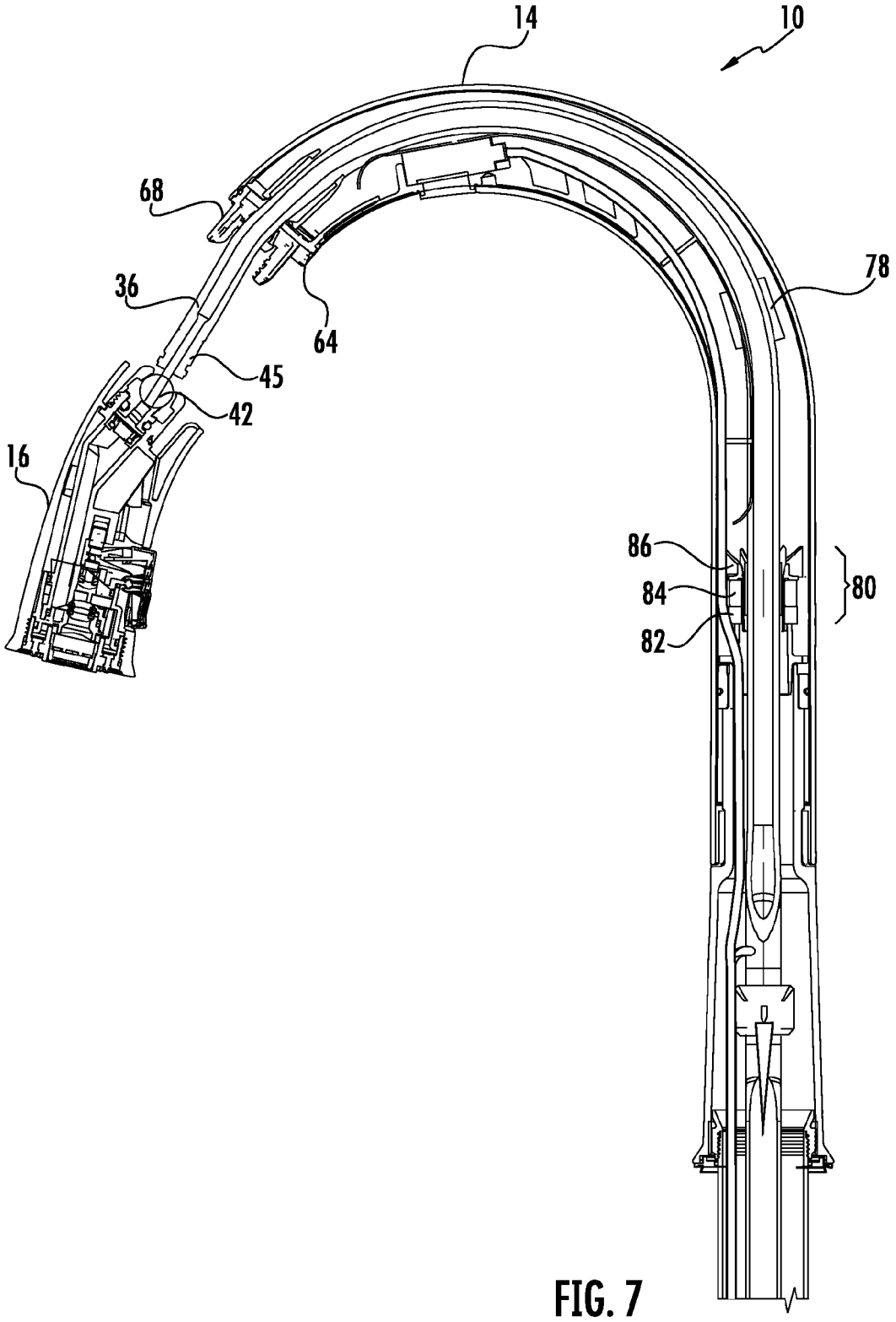
FIG. 7 is a right side elevational cross-section view of the faucet of FIG. 1, shown according to an exemplary embodiment.

The faucet shown in FIGS. 1 and 2 is shown in a first or docked position, in which the sprayhead is coupled to the spout. The faucet shown in FIG. 7 is shown in a second or undocked position. In the undocked position, the sprayhead is decoupled and spaced apart from the spout. In such a position, the hose is at least partially extracted from the spout. According to the embodiments shown, a magnetized docking assembly is located in the spout, and a magnetically responsive collar is coupled to the hose.

As the sprayhead is returned to the docked position, the docking assembly magnetically couples to and attracts the collar on the hose. According to the embodiment shown, the distance from the collar to the sprayhead is slightly less than the distance from the magnet to the end of the spout. Accordingly, the magnetic force of the docking assembly holds the sprayhead against the spout, thereby preventing the sprayhead from drooping from the spout end, which may be aesthetically unappealing. Further, the pull of the docking assembly transmitted through the sprayhead to the user provides the user a tactile feedback that the sprayhead is docked.

While the docking system herein is described with respect to a faucet, is contemplated that the docking system may be applied to any configuration that requires a hose, cable, rod, or line (e.g., rope, etc.) that needs to be temporarily held in position with or without tension, for example, water hoses for gardening or greenhouses, air hoses for industrial applications, hand held shower hose applications, halyards for banners or flagpoles, (electrical) extension cord coils, control devices, push/pull control rods, etc.

Before discussing further details of the faucet and/or the components thereof, it should be noted that references to "front," "back," "rear," "top," "bottom," "inner," "outer," "right," and "left" in this description are merely used to identify the various elements as they are oriented in the FIGURES. These terms are not meant to limit the element which they describe, as the various elements may be oriented differently in various applications.

It should further be noted that for purposes of this disclosure, the term "coupled" means the joining of two members directly or indirectly to one another. Such joining may be stationary in nature or moveable in nature and/or such joining may allow for the flow of fluids, electricity, electrical signals, or other types of signals or communication between the two members. Such joining may be achieved with the two members or the two members and any additional intermediate members being integrally formed as a single unitary body with one another or with the two members or the two members and any additional intermediate members being attached to one another. Such joining may be permanent in nature or, alternatively, may be removable or releasable in nature.

Referring to FIGS. 1 and 2, a faucet and components thereof are shown, according to an exemplary embodiment. A faucet 10 includes a base 12, a spout 14, and a sprayhead 16 releasably coupled to the spout 14. The faucet 10 is shown to include an arm 18 is configured to house and support a manual valve (not shown). The valve may be configured to control the volume, temperature, or some combination thereof, of the fluid (e.g., water, beverage, etc.) flow through the faucet. A handle 20 is coupled to the valve to control the operation thereof. According to other embodiments, the faucet 10 may not include an arm 18, and the valve and handle 20 may be located remotely from the faucet 10. According to various other embodiments, the faucet 10 may include an electronically controlled valve (e.g., solenoid valve) in addition to or instead of the manual valve.

The base 12 includes a sidewall 22, extending between a first or bottom end 24 to a second or top end 26, and an axially extending cavity 28. The bottom end 24 is configured to provide stable support to the faucet 10 when coupled to a surface (e.g., countertop, wall, bar, table, support structure, etc.). A stem 30 may be threadedly coupled to the bottom end 24 to extend through the surface and to couple to a clamping mechanism 32 configured to couple the stem 30 to an opposite side (e.g., underside, inside, etc.) of the surface.

The sidewall 22 is shown to at least partially define the cavity 28, which is configured to receive and permit the passage therethrough of water lines 34. For example, the cavity 28 is shown to receive a cold water line 34*a* and a hot water line 34*b*. According to the exemplary embodiment shown, the faucet 10 further includes an intermediary line 34*c* (e.g., jumper line, patch line, etc.), which extends between the manual valve and an electronically controlled valve (not shown).

Figure 3:
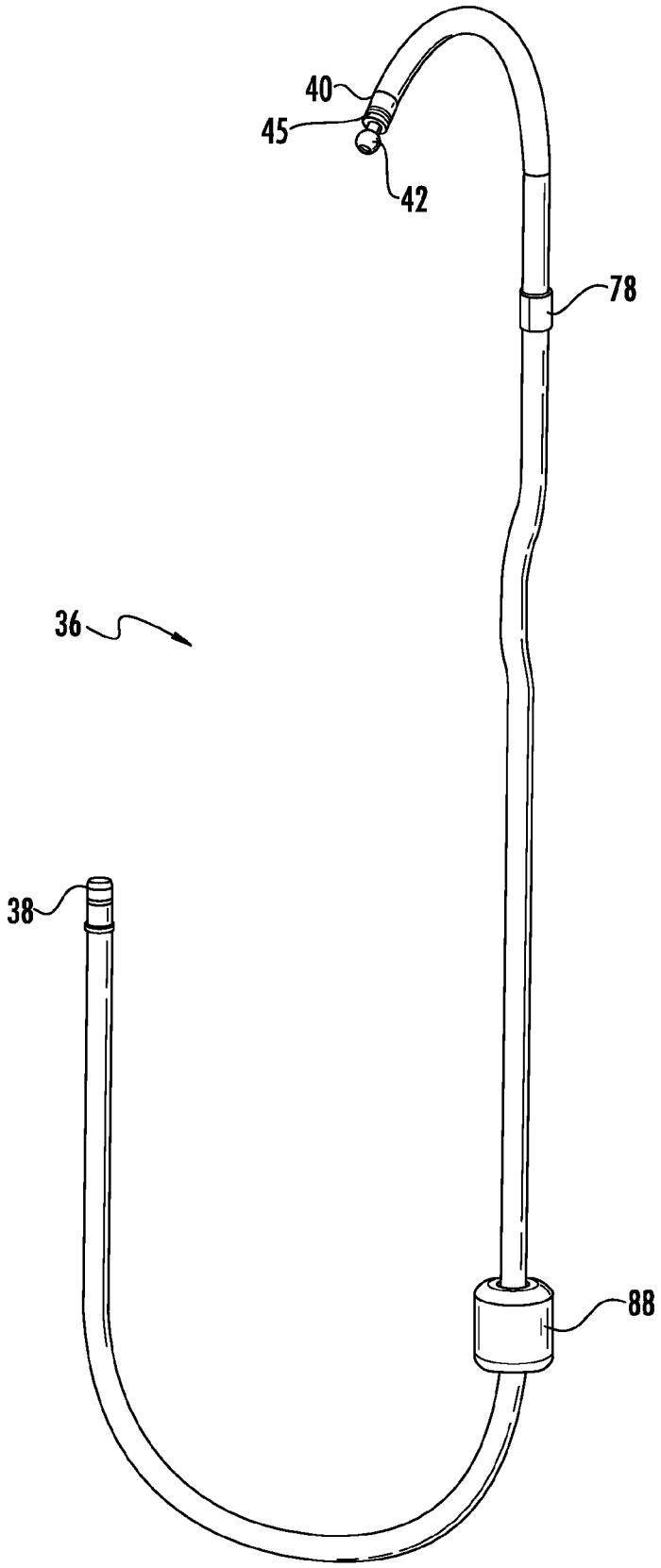
FIG. 3 is a perspective view of components of the faucet of FIG. 1, shown according to an exemplary embodiment.

Further referring to FIG. 3, the faucet 10 further includes an outlet line, shown as hose 36, according to an exemplary embodiment. The hose 36 is configured to carry water through the spout 14 to the sprayhead 16 and is sufficiently flexible to permit the hose to travel through the shape of the spout 14 while the sprayhead 16 is moved between the docked and undocked position. The hose 36 is preferably substantially inelastic in an axial direction to facilitate operation of the magnetic docking system. According to the exemplary embodiment shown, the hose 36 extends from a first or inlet end 38, which couples to the electronically controlled valve, to a second or outlet end 40, which couples to the sprayhead 16. According to another embodiment, the faucet 10 may not include an electronically controlled valve, in which case, the inlet end 38 of the hose 36 couples to the intermediary line 34*c*. The hose 36 further includes an end portion, shown as ball 42, coupled to the outlet end 40. The ball 42 is shown to include a member, shown as stem 43, extending into the hose 36. The ball 42 may be secured to the hose 36 via a clamp, shown as ferrule 45, that may be crimped or swaged onto the hose 36 and stem 43.

Figure 4:
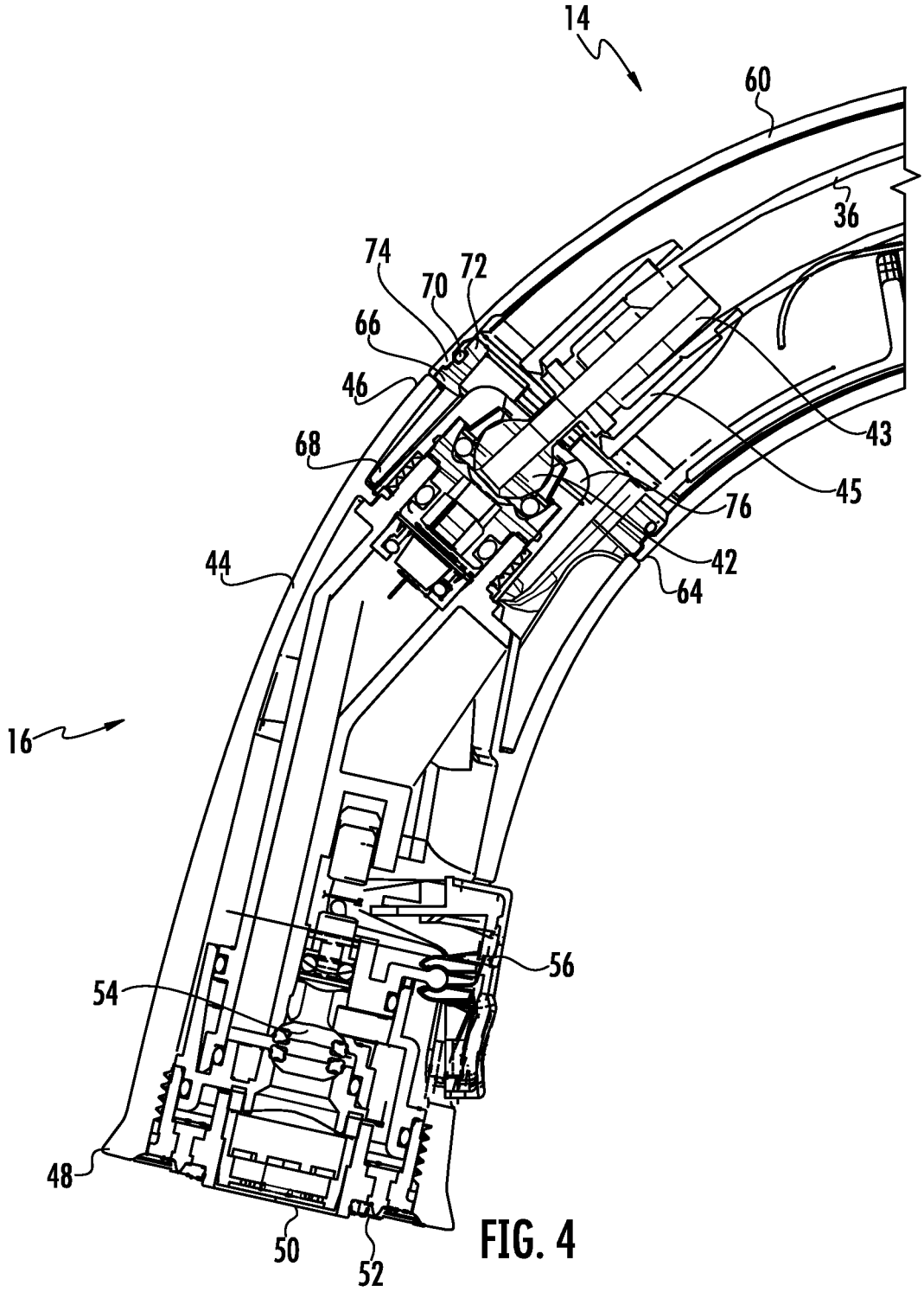
FIG. 4 is a right side elevational cross-section view of an enlarged portion of the faucet of FIG. 1, shown according to an exemplary embodiment.

Further referring to FIG. 4, the sprayhead 16 includes a sidewall 44 extending between a first or inlet end 46 and a second or outlet end 48. The sprayhead 16 transfers fluid from the hose 36 to an outlet port. For example, the sprayhead 16 may include an aerator 50 and one or more non-aerated nozzles 52. A diverter mechanism 54 controlled by a switch 56 may transition the flow between modes, e.g., divert flow to the aerator 50, to the nozzles 52, or pause the flow of fluid through the sprayhead 16.

The spout 14 includes a sidewall 60 extending from a first or bottom end 62 to a second or top end 64. The bottom end 62 couples to the top end 26 of the base 12. According to other embodiments, the spout 14 may be fixed to the base 12, but according to the embodiment shown, the spout 14 is rotatably coupled to the base 12 to provide direction and range of the outlet flow of fluid to the environment, i.e., provides a greater usable work area. The top end 64 is configured to releasably couple to the sprayhead 16.

According to the embodiment shown, the spout 14 includes a sprayhead support 66 coupled to the top end 64 of the spout 14. The sprayhead support 66 includes an at least partially annular flange 68 extending axially from the top end 64 and into the sprayhead 16 when the sprayhead 16 is in the docked position. The sprayhead support 66 helps to retain the sprayhead 16 in the docked position. For example, as shown, the annular flange 68 provides support to an inner portion of the sidewall 44 to resist shear forces and to align the inlet end 46 of the sprayhead 16 with the top end 64 of the spout 14. The sprayhead support 66 further provides visual and tactile cues to a user attempting to dock the sprayhead 16. The sprayhead support 66 may be threaded, press fit, or snapped into the spout 14. According to the embodiment shown, the sprayhead support 66 is retained in the spout 14 by a resilient member 70 (e.g., o-ring, snap ring, etc.) that is trapped between an outwardly extending ledge 72 on the sprayhead support 66 and an inwardly extending ledge 74 on the sidewall 60. According to other embodiments, the sprayhead support may be radially outward of (e.g., circumscribe) the sprayhead 16 and receive the sprayhead 16 therein, the sprayhead support may be coupled to the sprayhead 16 and extend into or around the top end 64 of the spout 14, or the faucet 10 may not include a sprayhead support 66.

As shown, the sprayhead 16 further includes a socket 76 proximate the inlet end 46 and configured to receive and retain ball 42 of the hose 36. According to the exemplary embodiment shown, the socket 76 is threadedly coupled to the sprayhead 16 after the hose 36 is passed through the socket 76. According to other embodiments, the socket 76 may be coupled to the sprayhead 16, and the ball 42 is then pressed or snapped into the socket 76.

Referring to FIGS. 1 and 2, the faucet 10 is shown in a first or docked position, and further referring to FIG. 7, the faucet 10 is shown in a second or undocked position, according to an exemplary embodiment. In the docked position, the sprayhead 16 is coupled to the top end 64 of the spout 14. In the undocked position, the sprayhead 16 is decoupled and spaced apart from the spout 14. In such a position, the hose 36 is at least partially extracted from the spout 14.

Figure 5:
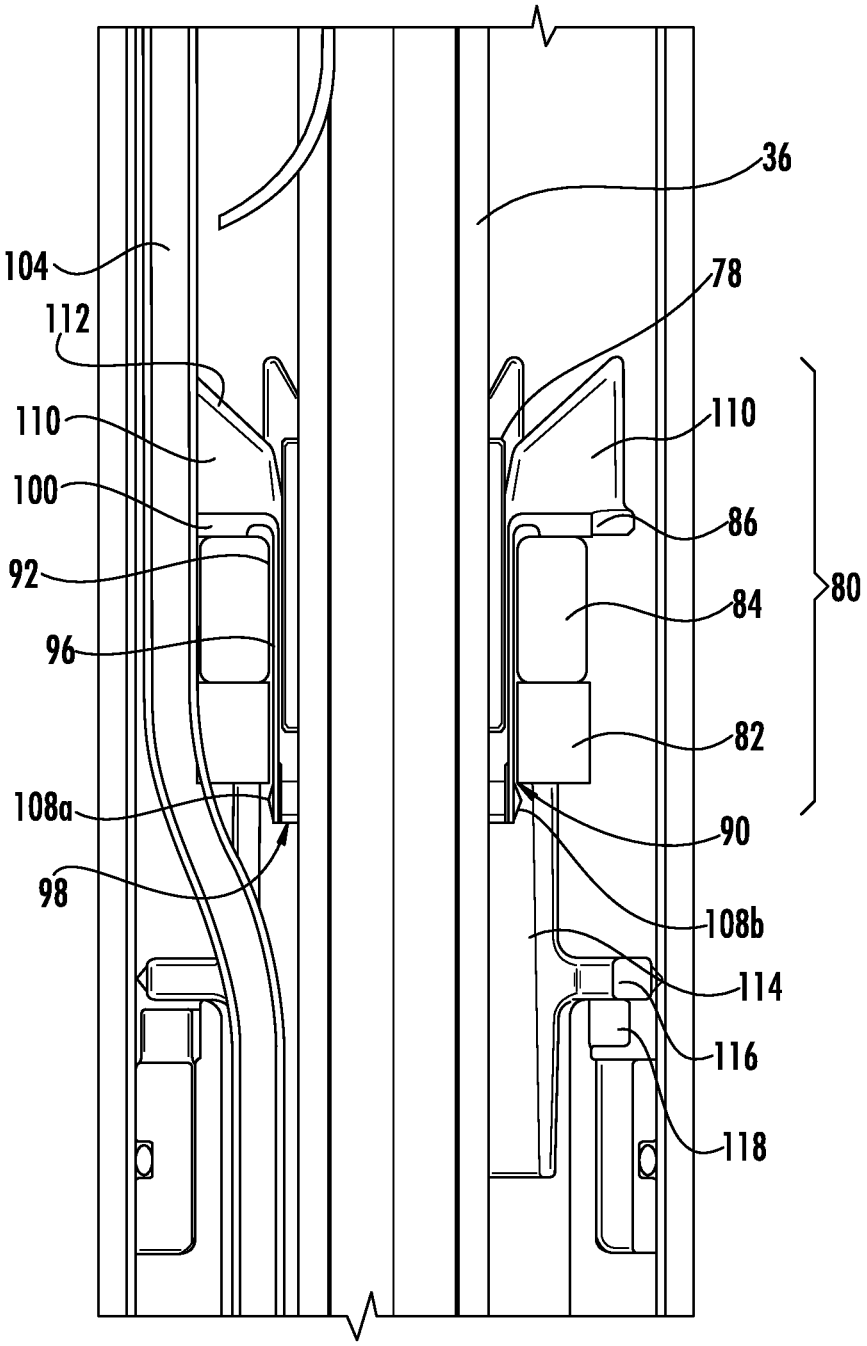
FIG. 5 is a right side elevational cross-section view of another enlarged portion of the faucet of FIG. 1, shown according to an exemplary embodiment.

Referring to FIG. 5, an enlarged portion of the exemplary embodiment of FIG. 2 is shown. A collar 78 is coupled to hose 36, according to an exemplary embodiment. According to one embodiment, the collar 78 is spliced into the hose 36. According to another embodiment, the collar 78 is "C" shaped collar that may be crimped onto the hose 36. According to another embodiment, the collar 78 is tubular and is crimped onto the hose 36 in position, for example, after being placed over the end of the hose 36 during assembly. According to yet another embodiment, the collar 78 may be coupled to one or more portions of the hose 36. For example, the collar 78 may join two portions of the hose 36, for example, by threading, crimping, a quick disconnect system, etc., to end portions of each of the hoses. According to one embodiment, the collar 78 may be or include the ferrule 45. For example, the collar 78 may be used to secure the stem 43 to the hose 36. According to another embodiment, the collar 78 may be coupled to the ferrule 45. The collar 78 may be made of any suitable magnetically responsive material (e.g., iron, steel, etc.). According to the exemplary embodiment shown, the collar 78 is formed of magnet grade stainless steel, i.e., stainless steel having high iron content.

The faucet 10 includes a docking assembly 80, which includes a magnet 82 and may include a field expander, shown as washer 84, and a retainer 86. When the sprayhead 16 is in the docked position, the collar 78 on the hose 36 is positioned proximate the docking assembly 80, and the magnet 82 magnetically couples to and attracts the collar 78. When the sprayhead 16 is moved to the undocked position, the hose 36 is partially extracted from the spout 14, and the collar 78 is moved away from the magnet 82, as shown in FIG. 7. During normal use, the collar 78 is moved sufficiently remote from the magnet 82 that the collar 78 and the magnet 82 magnetically decouple (i.e., magnetic field is sufficiently weak that the magnetic force applied to the collar 78 is negligible).

As the sprayhead 16 is returned to the docked position, the magnetic field from the magnet 82 couples to and attracts the collar 78. According to the embodiment shown, the distance from the collar 78 to the sprayhead 16 is slightly less than the distance from the magnet 82 to the end of the spout 14. Accordingly, magnetic force of the docking assembly 80 holds the sprayhead 16 against the end of the spout 14, thereby preventing the sprayhead from drooping, which may be aesthetically unappealing.

A weight 88 (shown in FIGS. 1 and 3) may be coupled to the hose 36 to help balance the sprayhead 16 and to retract the hose 36 into the spout 14. The weight 88 may be less massive than a conventional weight because the weight 88 need not retain the entire weight of the sprayhead 16 in the docked position. For example, the weight 88 may only compensate for the weight of the hose 36 as it is being fed into the spout 14 while the sprayhead 16 is being returned to the docked position since the docking assembly 80 provides the force necessary to retain the sprayhead 16 in the docked position. According to another embodiment, conventional weight may be used to retract the sprayhead 16 back to the spout, i.e., the faucet 10 would have a "self-retracting" sprayhead 16.

The magnet 82 is shown to have an annular shape having a bore 90 (e.g., aperture, opening, cavity, etc.) to permit the hose 36 to pass therethrough. The magnet 82 may be a permanent magnet, for example, formed of iron, nickel, cobalt, a rare earth element, etc. According to the exemplary embodiment, the magnet 82 is formed of neodymium. According to the exemplary embodiment, the docking assembly 80 is located in a portion of the faucet 10 having more available space than the top end 64 of the spout 14. Accordingly, the docking assembly 80 may include a larger, less magnetically dense, lower cost magnet 82. The docking assembly 80 may include magnets of various number, composition, shape, and size to provide customized performance for a given application. As will be described in detail below, the magnetic field from the magnet 82 is configured to selectively couple to the collar 78 to retain the sprayhead 16 in the docked position.

According to other embodiments, the magnet 82 may be an electromagnet. Using an electromagnet allows calibration or adjustment of the force required to decouple the sprayhead 16 from the spout 14. For example, the user may be able to reduce the strength of the magnetic field to facilitate undocking of the sprayhead 16. Another user may increase the strength of the magnetic field to inhibit unwanted undocking of the sprayhead 16, for example, by a child. According to another embodiment, a controller may receive a signal from a touch sensor (e.g., capacitive sensor) that a user has touched the sprayhead 16. The controller may then reduce or remove power from the electromagnet, thereby enabling easy removal of the sprayhead 16 from the spout 14. The controller may then increase or restore power to the electromagnet when the controller receives a signal from the touch sensor that the user is no longer touching the sprayhead 16, for example, when the sprayhead 16 has been returned to the docked position.

Figure 8B:
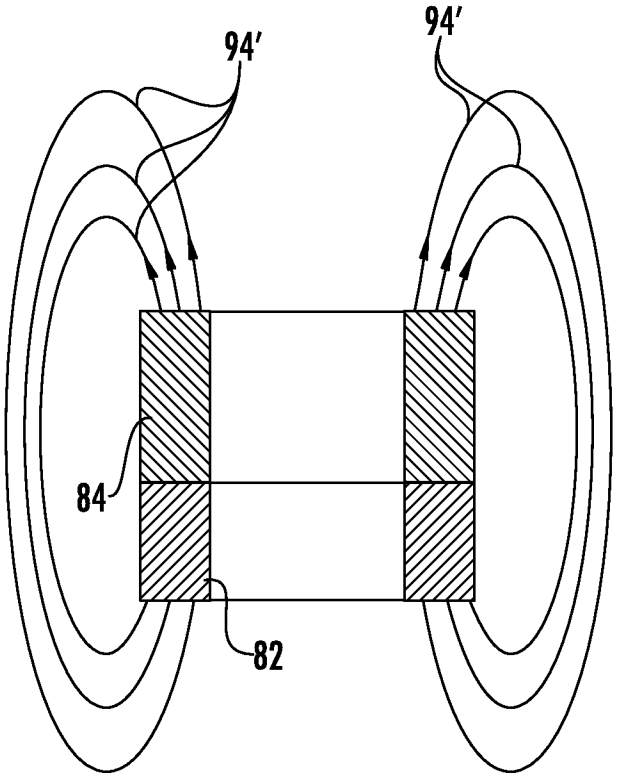
FIGS. 8A and 8B are schematic diagrams of a magnet of FIG. 1, shown according to an exemplary embodiment.
Figure 8A:
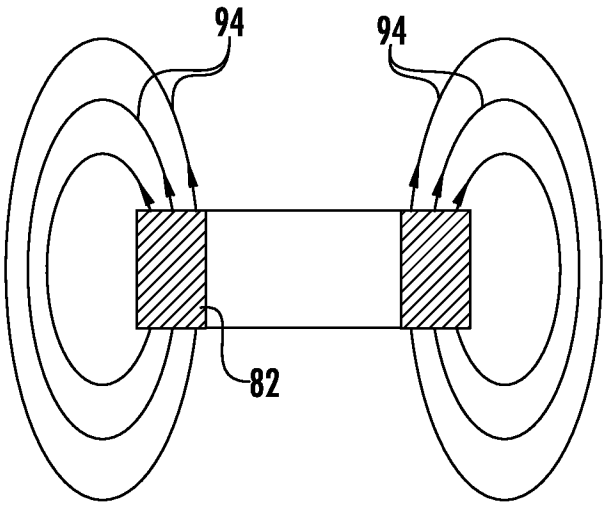
Figure 10:
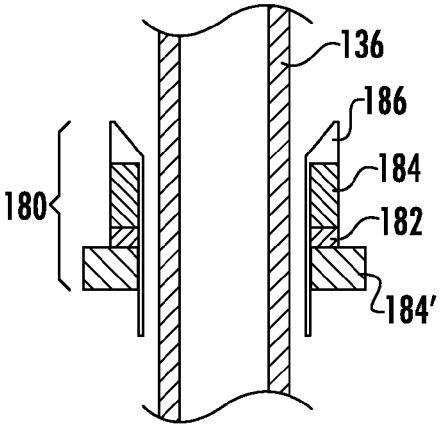
FIG. 10 is a schematic cross-section view of components of a docking system, shown according to another exemplary embodiment.

The docking assembly 80 may further include a washer 84, configured to expand or elongate the magnetic field created by the magnet 82. The field expander may be formed of any suitable material, for example, iron, steel, etc. As shown, the washer 84 has an annular shape having a bore 92 (e.g., aperture, opening, cavity, etc.) to permit the hose 36 pass therethrough. Referring to FIG. 8A, a schematic diagram of the magnet 82 and its flux lines 94 shows that the magnetic field extends a first distance from the magnet. Referring to FIG. 8B, a schematic diagram of the flux lines 94' of the magnet 82 as affected by the washer 84 shows that the washer 84 conducts the magnetic field to elongate or expand the field in an axial direction. Referring to FIG. 10, various numbers, sizes, shapes, and compositions of the washers 84 may be used to provide customized performance for various applications. As shown, the docking assembly 180 includes a retainer 186, a magnet 182, a first field expander 184 located on a first side of the magnet 182, and a second field expander 184' located on a second side of the magnet 182. The customized size, shape, and strength of the field may be used to attract a collar (not shown) coupled to the line or hose 136.

Figure 6:
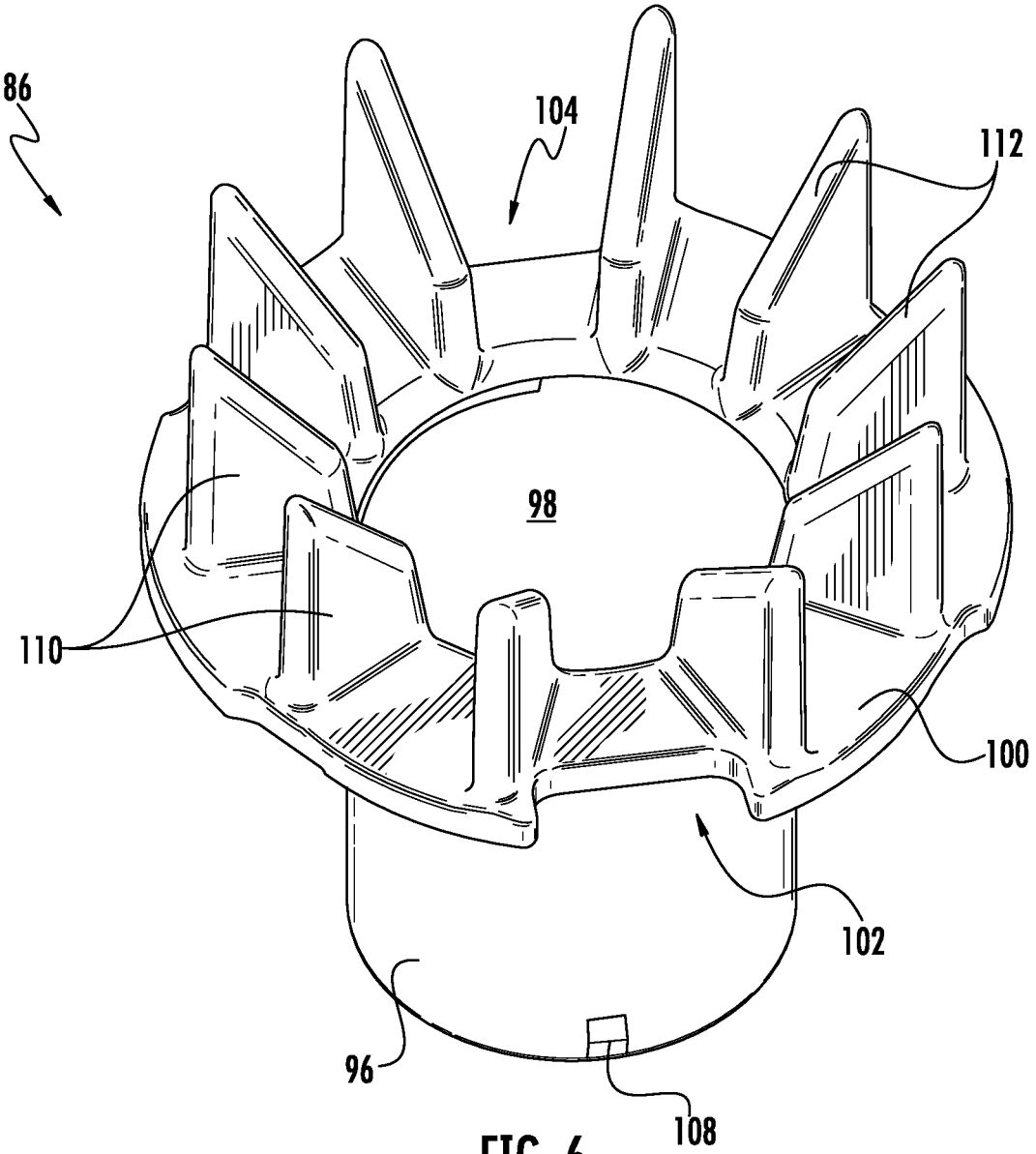
FIG. 6 is a perspective view of a component of the faucet of FIG. 1, shown according to an exemplary embodiment.

Further referring to FIG. 6, the docking assembly 80 may further include a retainer 86 configured to support the magnet 82 and the washer 84. The retainer 86 is shown to include an axially extending sidewall 96 having a first or top end and a second or bottom end axially opposite the first end. The sidewall 96 passes through bore 90 of the magnet 82 and the bore 92 of the washer 84, and in turn the sidewall 96 defines a bore 98 (e.g., aperture, opening, cavity, passageway, etc.) configured to permit collar 78 to pass therethrough. The magnet 82 may be magnetized before or after the magnet 82 is coupled to the retainer 86. A flange 100 extends outwardly from the top end and may define a cutout 102 configured to allow a wire or cable 104 to pass thereby. The cable 104 may carry electrical signals and/or power to or from a sensor 106, which may be used to cause actuation of the electrically controlled valve. At least one boss 108, shown as first boss 108*a*, and second boss 108*b*, may extend outwardly from the bottom end of the retainer 86. The bosses 108 extend radially outwardly beyond the inner diameter of the magnet 82. During assembly, the resilient nature of the boss 108 and/or sidewall 96 may permit the boss 108 and/or sidewall 96 to compress inwardly allowing the washer 84 and the magnet 82 to be forced (e.g., pushed, pulled, pressed, etc.) onto the retainer 86. The boss 108 and/or the sidewall 96 then returned to their natural or uncompressed state, thereby mechanically retaining the washer 84 and the magnet 82 onto the retainer 86. The retainer 86 further includes one or more upwardly extending fins 110. The fins 110 include a top surface 112 that slopes downwardly an inwardly towards the bore 98 in order to guide the collar 78 into the bore 98 as the sprayhead 16 is returned to a docked position. The fins 110 may also help guide the hose end 38 through the retainer 86 during assembly.

According to one embodiment, the docking assembly 80 may be supported by coupling to the sidewall 60 of the spout 14. According to another embodiment, the docking assembly 80 may be interconnectedly supported by the base 12. According to the embodiment shown, the magnet 82 rests upon an annular support structure 114. The support structure 114 has an outwardly extending flange 116, which is supported by a column 118, which in turn may be supported by or may be part of the base 12. According to another embodiment, the docking assembly 80 may be supported by the base 12. According to the embodiment shown, the support structure 114 is part of a swivel assembly enabling the spout 14 to swivel (i.e., rotate relative to) relative to the base 12. Accordingly, the magnet 82 of the docking assembly 80 is proximate the swivel coupling between the base 12 and the spout 14. In other embodiments, the magnet 82 and the docking assembly 80 may be located proximate the top end 64 of the spout 14, between the top end 64 and the apex of the spout 14, at the apex of the spout 14, or between the apex of the spout 14 and the bottom end 62 of the spout 14. While the docking assembly 80 is shown to be located in the spout 14, is contemplated that the docking assembly 80 may be located elsewhere, for example, in the base 12 or a portion of the faucet beneath support surface.

Figure 9A:
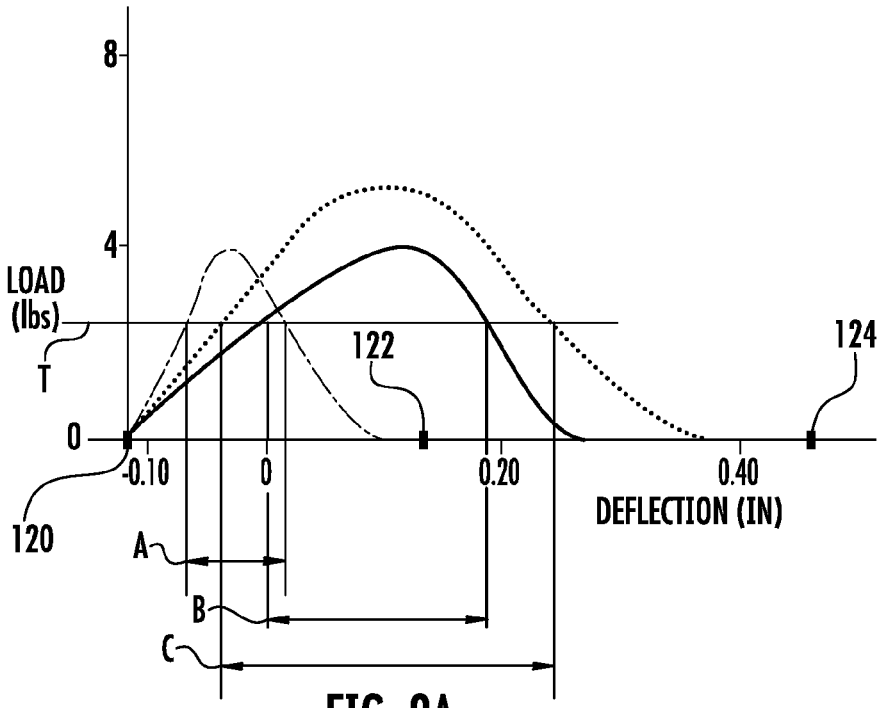
FIG. 9A is a graph of load versus deflection and corresponding schematic diagrams 9B-9D, shown according to an exemplary embodiment.
Figure 9B:
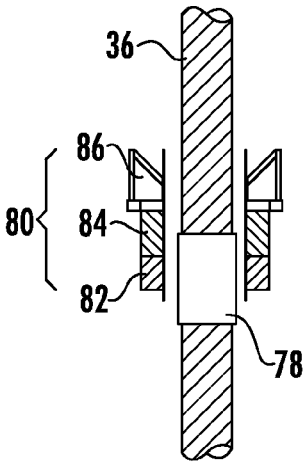
FIGS. 9B-9D are schematic diagrams of components of the faucet of FIG. 1 in various relation to one another, shown according to an exemplary embodiment.
Figure 9C:
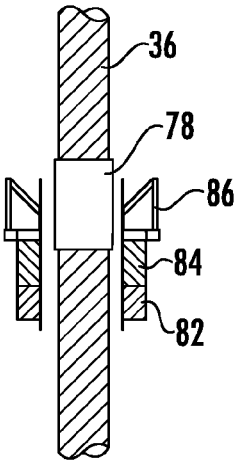
Figure 9D:
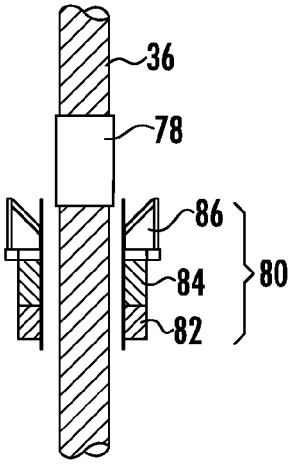

Referring to FIG. 9A, a graph of load versus deflection and corresponding schematic diagrams 9B-9D of the collar 78 relative to the docking assembly 80 are shown, according to exemplary embodiments. FIGS. 9B, 9C, and 9D generally correspond to abscissa 120, abscissa 122, and abscissa 124 in FIG. 9A, respectively. Specifically referring to FIG. 9B, the collar 78 is attracted to the center of the magnet 82 (e.g., the center of the magnetic field, the center of the magnetic flux, etc.). At this location, the magnetic forces attracting the collar 78 in both axial directions are balanced, and no resultant magnetic load is applied to the collar 78. Referring to FIG. 9D, the collar 78 is sufficiently far away from the magnet 82 that the magnetic load on the collar 78 is negligible. Referring to FIG. 9C, the collar 78 is shown in a position at which the magnetic load on the collar 78 is at a maximum. This location is between the positions of FIGS. 9B and 9D.

Referring to FIG. 9A, when the magnetic load exceeds a threshold value T, the magnetic forces on the collar 78 exceed the weight of the sprayhead 16 and an unsupported portion of the hose 36. Thus, when the magnetic forces exceed the threshold value, the sprayhead 16 is retracted and/or retained to the spout 14. This region in which the magnetic forces exceed the threshold value T may be referred to as the "sweet spot". According to an exemplary embodiment, the collar 78 is located on the hose 36 such that when the sprayhead 16 is in the docked position, the collar 78 is in the sweet spot. Thus, a predictable minimum load is provided at all tolerance extremes, and the sprayhead 16 is retained in the docked position.

Further referring to FIG. 8A, the dashed line in FIG. 9A corresponds to a docking assembly having a magnet 82 only. In such case the sweet spot A is relatively narrow, that is, the sweet spot has a relatively short axial length. Further referring to FIG. 8B, the solid line in FIG. 9A corresponds to a docking assembly having a magnet 82 and a washer 84. In such case, the magnitude of the magnetic forces remains substantially the same; however, the forces occur over a greater axial distance. Thus, the sweet spot B is expanded, thereby allowing greater tolerances and providing a more robust magnetic docking system. The dotted line in FIG. 9A corresponds to a docking assembly having a field expander (e.g., a washer) and a larger magnet. In such case, the magnitude of the force increases and the forces occur over an even greater distance, thus creating an even larger sweet spot C. The long smooth curve of the larger magnet and field expander provides the user docking and undocking the sprayhead 16 a more gentle retraction and a more gentle extension. Accordingly, the size, shape, number, and composition (e.g., materials, magnetic density, etc.) of the magnets and field expanders may be selected to provide a desired force magnitude and sweet spot size for the space available in the faucet in view of cost constraints. Thus, while exemplary values and curves are shown and described in FIG. 9A, other curves may result for other configurations of magnets and field expanders.

Figure 11:
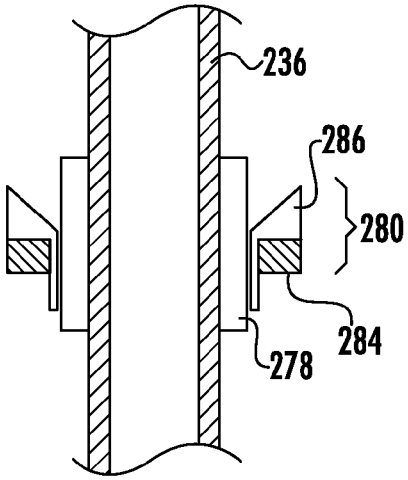
FIG. 11 is a schematic cross-section view of components of a docking system, shown according to another exemplary embodiment.
Figure 12A:
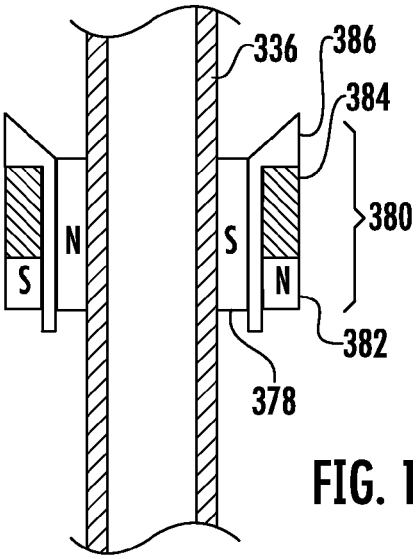
FIGS. 12A and 12B are schematic cross-section views of components of a docking system, shown according to another exemplary embodiment.
Figure 12B:
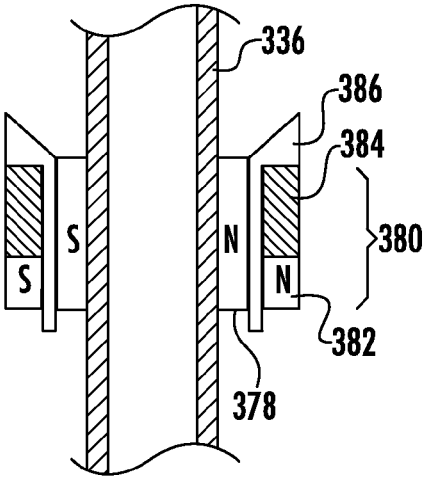

Referring generally to FIGS. 11-12B, it is contemplated that the collar coupled to the hose may be magnetized (e.g., be a permanent magnet or an electromagnet). Referring specifically to the exemplary embodiment of FIG. 11, a docking assembly 280 includes a retainer 286 supporting a magnetically responsive ring 284. A magnetized collar 278 is coupled to the hose 236. In operation, the magnetic interaction between the collar 278 and the ring 284 draw the collar 278 towards a position in which the ring 284 circumscribes a midpoint (e.g., midsection, equator, magnetic equator, etc.) of the collar 278.

Referring to the exemplary embodiment of FIGS. 12A and 12B, a docking assembly 380 includes a magnet 382, a field expander 384, and a retainer 386. A hose 336 and a magnetized collar 378 pass through the docking assembly 380. FIG. 12A shows a first position in which the magnetic poles of the collar 378 are opposite the poles of the magnet 382 (e.g., N-S or S-N). Accordingly, the collar 378 is attracted to the magnet 382, and a sprayhead coupled to the hose 336 is retained in a docked position. FIG. 12B shows a second position in which the magnetic poles of the collar 378 are similarly aligned with the poles of the magnet 382 (e.g., N-N or S-S). Accordingly, the collar 378 is repelled by the magnet 382, and the sprayhead coupled to the hose 336 is pushed out of the docked position. According to one embodiment, the hose 336 may be sufficiently rigid such that when the sprayhead is rotated (e.g., by a user desiring to undock the sprayhead), the collar 378 rotates relative to the docking assembly 380 from the first position to the second position, thereby easing removal of the sprayhead from the docked position. When the sprayhead is returned to the docked position, the magnetic fields of the collar 378 and the magnet 382 oppositely align the poles of the collar and the magnet into the first position. According to another embodiment, the magnet 382 is an electromagnet. A controller may be configured to reverse the polarity of the magnet 382 in response to a signal. For example, the signal may be from a touch sensor indicating that a user has touched the sprayhead 16.

The construction and arrangement of the elements of the faucet as shown in the exemplary embodiments are illustrative only. Although only a few embodiments of the present disclosure have been described in detail, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements. The elements and assemblies may be constructed from any of a wide variety of materials that provide sufficient strength or durability, in any of a wide variety of colors, textures, and combinations. Additionally, in the subject description, the word "exemplary" is used to mean serving as an example, instance or illustration. Any embodiment or design described herein as "exemplary" is not necessarily to be construed as preferred or advantageous over other embodiments or designs. Rather, use of the word "exemplary" is intended to present concepts in a concrete manner. Accordingly, all such modifications are intended to be included within the scope of the present disclosure. Other substitutions, modifications, changes, and omissions may be made in the design, operating conditions, and arrangement of the preferred and other exemplary embodiments without departing from the scope of the appended claims.

The order or sequence of any process or method steps may be varied or re-sequenced according to alternative embodiments. Any means-plus-function clause is intended to cover the structures described herein as performing the recited function and not only structural equivalents but also equivalent structures. Other substitutions, modifications, changes and omissions may be made in the design, operating configuration, and arrangement of the preferred and other exemplary embodiments without departing from the scope of the appended claims.

What is claimed is:

1. A faucet, comprising:

a spout;

a sprayhead releasably coupled to the spout;

a hose coupled to the sprayhead and having a magnetically responsive collar thereon, the hose providing fluid through the spout to the sprayhead; and a magnet located in the faucet such that when the sprayhead is coupled to the spout, the collar magnetically couples to the magnet, thereby applying sufficient magnetic force to the hose to retain the sprayhead against the spout; and a retainer having a wall extending through an internal bore of the magnet to couple the magnet and the retainer.

2. The faucet of claim 1, wherein the hose passes through the internal bore of the magnet.

3. The faucet of claim 1, wherein the magnet is located in the spout.

4. The faucet of claim 1, further comprising a base coupled to the spout and configured to mount the faucet to another object, wherein the magnet is located in the base.

5. A faucet, comprising:

a spout;

a sprayhead releasably coupled to the spout;

a hose coupled to the sprayhead and having a magnetically responsive collar thereon, the hose providing fluid through the spout to the sprayhead;

a magnet located in the faucet such that when the sprayhead is coupled to the spout, the collar magnetically couples to the magnet, thereby applying sufficient magnetic force to the hose to retain the sprayhead against the spout; and a retainer having a wall extending through a bore of the magnet to support the magnet, wherein when the collar and the magnet are magnetically coupled, the collar is disposed in a bore of the retainer, such that the wall of the retainer is positioned between the magnet and the collar.

6. A faucet, comprising:

a spout;

a sprayhead releasably coupled to the spout;

a hose coupled to the sprayhead and having a magnetically responsive collar thereon, the hose providing fluid through the spout to the sprayhead;

a magnet located in the faucet such that when the sprayhead is coupled to the spout, the collar magnetically couples to the magnet, thereby applying sufficient magnetic force to the hose to retain the sprayhead against the spout;

a retainer having a wall extending through a bore of the magnet to support the magnet; and a field expander configured to expand a magnetic field created by the magnet, wherein the wall of the retainer also extends through a bore of the field expander to support the field expander.

7. The faucet of claim 6, wherein when the collar and the magnet are magnetically coupled, the collar is disposed in a bore of the retainer, such that the wall of the retainer is positioned between the field expander and the collar.

8. A faucet, comprising:

a spout having a first end, a second end, and an apex disposed between the first and second ends;

a sprayhead detachably coupled directly to the second end of the spout;

a hose coupled to the sprayhead and configured to carry fluid thereto;

a magnetically responsive collar coupled to the hose; and a magnet located in the spout between the apex and the first end;

wherein the collar magnetically couples to the magnet when the sprayhead is coupled to the spout to retain the sprayhead to the spout.

9. The faucet of claim 8, wherein the magnet comprises a rare earth element having a low magnetic density relative to other rare earth elements.

10. The faucet of claim 8, further comprising a retainer that supports the magnet, wherein at least a portion of the retainer is positioned between the magnet and the collar when the sprayhead is coupled to the spout.

11. The faucet of claim 10, wherein the collar is disposed in an internal bore of the retainer when the sprayhead is coupled to the spout, and wherein the retainer is disposed in an internal bore of the magnet.

12. The faucet of claim 8, wherein the sprayhead includes a touch sensor that is configured to send a signal to a controller upon a user touching the sprayhead, wherein the signal is configured to reverse the polarity of the magnet.

13. The faucet of claim 8, further comprising:

a sensor disposed in the spout between the magnet and the second end, the sensor configured to cause actuation of the faucet upon a detection; and a wire passing through the second end of the spout and configured to supply electric power to at least one of the sensor and the magnet.

14. A faucet comprising:

a spout having a first end, a second end, and an apex disposed between the first and second ends;

a sprayhead detachably coupled to the second end of the spout;

a hose coupled to the sprayhead and configured to carry fluid thereto;

a magnetically responsive collar coupled to the hose;

a magnet located in the spout between the apex and the first end, wherein the collar magnetically couples to the magnet when the sprayhead is coupled to the spout to retain the sprayhead to the spout; and a base that is configured to support the magnet and mount the faucet to another object, wherein the first end of the spout is coupled to the base.

15. The faucet of claim 14, wherein the spout is rotatably coupled to the base.

16. A faucet, comprising:

a spout;

a sprayhead detachably coupled to the spout;

a hose coupled to the sprayhead and configured to carry fluid thereto;

a magnetically responsive collar coupled to the hose;

a magnet configured to magnetically couple to the collar when the sprayhead is coupled to the spout to retain the sprayhead to the spout; and a retainer including a first end that engages an internal bore of the magnet and a second end having a fin that guides the collar into a bore of the retainer and the bore of the magnet.

17. The faucet of claim 16, wherein the first end of the retainer is an annular sidewall extending along a longitudinal axis, wherein the second end of the retainer is an annular flange that extends outward from the sidewall, and wherein the fin extends radially from the longitudinal axis and from the flange opposite the sidewall.

18. The faucet of claim 17, wherein the fin comprises a plurality of fins, each fin extending radially from the longitudinal axis and from the flange opposite the sidewall.

19. The faucet of claim 18, wherein a cutout is provided in the flange between two adjacent fins to allow for routing of another element of the faucet by the retainer.

20. The faucet of claim 16, wherein a top surface of the fin slopes toward the first end of the retainer moving from outboard to inboard.

* * * * *